US008690561B2

(12) United States Patent
Lee et al.

(10) Patent No.: US 8,690,561 B2
(45) Date of Patent: Apr. 8, 2014

(54) METHOD AND APPARATUS FOR VACUUM PROCESS OF ISOSTATIC PRESSING OF POWDER MATERIAL

(75) Inventors: Jin Sung Lee, Daejeon (KR); Hee Duk Park, Daejeon (KR); Hee Sul Sa, Daejeon (KR)

(73) Assignee: Agency for Defense Development, Daejeon (KR)

( * ) Notice: Subject to any disclaimer, the term of this patent is extended or adjusted under 35 U.S.C. 154(b) by 657 days.

(21) Appl. No.: 12/897,015

(22) Filed: Oct. 4, 2010

(65) Prior Publication Data

US 2012/0025409 A1 Feb. 2, 2012

(30) Foreign Application Priority Data

Jul. 27, 2010 (KR) ..... 10-2010-0072589

(51) Int. Cl.
*C06B 21/00* (2006.01)
*B22F 3/02* (2006.01)

(52) U.S. Cl.
USPC ..... 425/388; 425/405.2; 425/389

(58) Field of Classification Search
USPC ..... 425/389, 405.2, 388; 264/3.4
See application file for complete search history.

(56) References Cited

U.S. PATENT DOCUMENTS 3,551,946 A * 1/1971 Backer et al. ..... 419/68
5,250,255 A * 10/1993 Sagawa et al. ..... 419/39

* cited by examiner

*Primary Examiner* — Amjad Abraham
*Assistant Examiner* — Kimberly A Stewart
(74) *Attorney, Agent, or Firm* — Scully, Scott, Murphy & Presser, P.C.

(57) ABSTRACT

A method for a vacuum process of isostatic pressing of powder material comprises preparing an explosive charged rubber bag by charging a rubber bag with powder, forming a vacuum environment by putting the explosive charged rubber bag in a vacuum box, sealing an inlet of the explosive charged rubber bag which is in a vacuum state, and maintaining the vacuum state by putting the explosive charged rubber bag in a fluid contained in a reservoir by a predetermined depth in a state that the inlet of the explosive charged rubber bag has been sealed.

6 Claims, 4 Drawing Sheets

METHOD AND APPARATUS FOR VACUUM PROCESS OF ISOSTATIC PRESSING OF POWDER MATERIAL

CROSS-REFERENCE TO A RELATED APPLICATION

Pursuant to 35 U.S.C. §119(a), this application claims the benefit of earlier filing date and right of priority to Korean Application 10-2010-0072589, filed on Jul. 27, 2010, the content of which is incorporated by reference herein in its entirety.

BACKGROUND OF THE INVENTION

1. Field of the Invention

The present invention relates to a method and apparatus for a vacuum process, and particularly, to a method and apparatus for a vacuum process of isostatic pressing of powder material.

2. Background of the Invention

Isostatic pressing is a type of pressing of powder material, and is utilized to obtain a uniform density by applying a pressure to powder material in every direction. As one example, metallic powder undergoes isostatic pressing and a sintering process to fabricate a metallic tool. As another example, ceramic powder undergoes isostatic pressing to massively fabricate each kind of electric or mechanical components.

Methods for charging a high explosive in a weapon system include a melting type for charging a high explosive in a melting manner, a casting type, a pressing type for pressing explosive raw materials with a high pressure and then processing in correspondence to a shape of the weapon system, etc. Especially, in case of the pressing type, isostatic pressing is used to fabricate powder molded body having a uniform density.

If explosive powder to be isostatic-pressed contains air remaining therein, the air is pressed in an insulated state when the explosive powder undergoes isostatic pressing. This may cause a hot spot to increase a possibility of explosion. Accordingly, the air inside the explosive powder need to be removed at a previous stage of the isostatic pressing.

In order to remove the air, a vacuum pump is connected to an inlet of a rubber bag containing explosive powder therein to perform a vacuum process. However, the inlet of the rubber bag may be sealed due to a vacuum state implemented during the vacuum process. Furthermore, while the inlet of the rubber bag is sealed, air may be introduced into the rubber bag little by little. This may cause the vacuum state inside the explosive powder to be gradually changed into a non-vacuum state. This explosive powder may cause an inferior density of a molded explosive body, thereby resulting in degradation of massive production.

SUMMARY OF THE INVENTION

Therefore, an object of the present invention is to provide a method and apparatus for a vacuum process of isostatic pressing of powder material capable of easily implementing a vacuum state inside powder, and capable of stably maintaining the vacuum state for a long time.

To achieve these and other advantages and in accordance with the purpose of the present invention, as embodied and broadly described herein, there is provided a method for a vacuum process of isostatic pressing of powder material, the method comprising: preparing an explosive charged rubber bag by charging a rubber bag with powder; forming a vacuum environment by putting the explosive charged rubber bag in a vacuum box; sealing an inlet of the explosive charged rubber bag which is in a vacuum state; and maintaining the vacuum state by putting the explosive charged rubber bag in a fluid contained in a tank by a predetermined depth in a state that the inlet of the explosive charged rubber bag has been sealed.

In the step of forming a vacuum environment, the inlet of the explosive charged rubber bag may be open until the vacuum environment is completely formed.

The step of sealing the inlet of the explosive charged rubber bag may include sealing the inlet of the explosive charged rubber bag by a temporary inlet sealing means when a vacuum state of the explosive charged rubber bag disposed in the vacuum box is completely implemented, opening the vacuum box, sealing the inlet of the explosive charged rubber bag by a clamp, and removing the temporary inlet sealing means.

The clamp may include a fixed plate and a moveable plate configured to seal the inlet by pressing the inlet of the explosive charged rubber bag by narrowing a gap therebetween; bolts fixed to one of the fixed plate and the moveable plate; and nuts coupled to the bolts.

The tank may be implemented as a water tank containing water therein.

In the step of forming the vacuum state of the explosive charged rubber bag in the vacuum box, an operation temperature of the explosive charged rubber bag may be controlled by a first heater.

The explosive charged rubber bag put in the tank may maintain a constant temperature by a second heater.

The powder may be explosive powder.

The method for a vacuum process of isostatic pressing of powder material may be applied to metallic material or ceramic material, etc.

To achieve these and other advantages and in accordance with the purpose of the present invention, as embodied and broadly described herein, there is also provided an apparatus for a vacuum process of isostatic pressing of powder material, the apparatus comprising: a rubber bag configured to charge powder therein; a vacuum box configured to accommodate therein an explosive charged rubber bag implemented as powder is charged in the rubber bag, and providing a vacuum environment of the explosive charged rubber bag; a temporary inlet sealing means configured to seal an inlet of the explosive charged rubber bag disposed in the vacuum box; a clamp configured to completely seal the inlet of the explosive charged rubber bag having been temporarily sealed by the temporary inlet sealing means; and a fluid tank configured to position the explosive charged rubber bag having the inlet sealed by the clamp at a predetermined depth.

The temporary inlet sealing means may be implemented as a hydraulic or pneumatic cylinder assembly arranged in the vacuum box.

The present invention may have the following advantages.

Firstly, since the inlet of the explosive charged rubber bag sealed by the clamp is completely sealed by the fluid contained in the tank, a vacuum state may be maintained. This may not lower a vacuum degree inside the explosive charged rubber bag even if time lapses after a vacuum process.

The explosive charged rubber bag may be kept in the fluid tank in large numbers. The plurality of rubber bag charge bodies may simultaneously undergo isostatic pressing, thereby significantly enhancing molding efficiency. This may greatly lower density inferiority occurring after a molding process, thereby significantly reducing an inferiority ratio of a molded body.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Hereinafter, a method and apparatus for a vacuum process of isostatic pressing of powder material according to the present invention will be explained in more detail with reference to the attached drawings.

Figure 1:
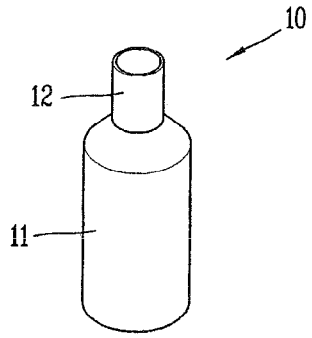
FIG. 1 is a perspective view of an explosive charged rubber bag implemented as explosive powder is charged in a rubber bag according to the present invention.

FIG. 1 is a perspective view of an explosive charged rubber bag implemented as explosive powder is charged in a rubber bag according to the present invention. As shown in FIG. 1, for isostatic pressing, explosive powder is heated to an operation temperature, and then is charged in the rubber bag 11. The rubber bag 11 is formed of an elastic material so that a uniform pressure can be applied to the explosive powder charged in the rubber bag 11, and the applied pressure can not leak out. At one end of the rubber bag 11, there is formed an inlet 12 protruding to facilitate clamping in order to maintain a vacuum state of the explosive powder or the inside. The rubber bag 11 in which the explosive powder has been charged is referred to as an explosive charged rubber bag 10.

Figure 2:
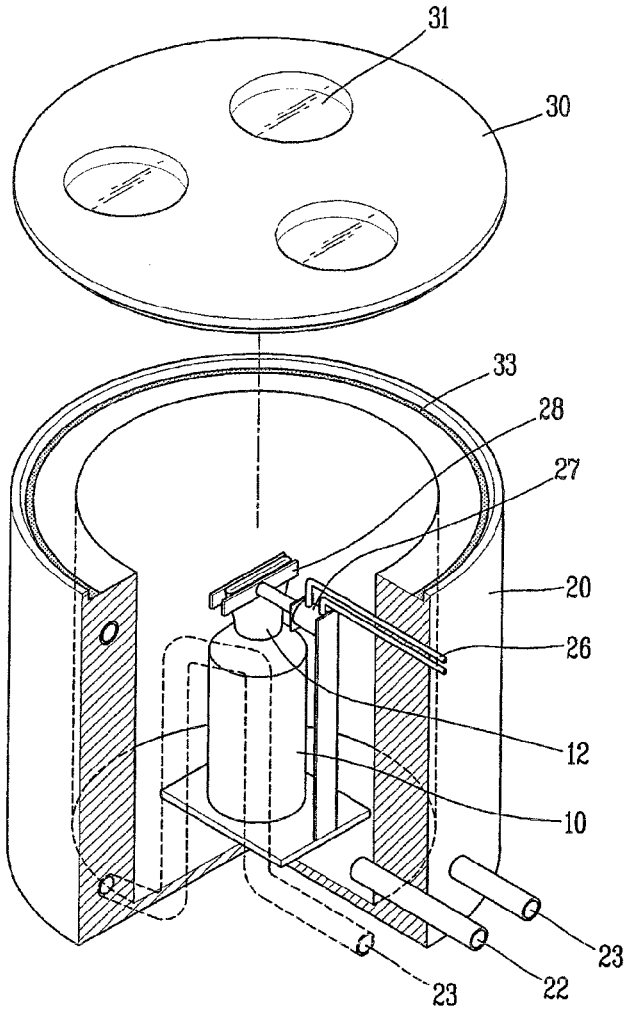
FIG. 2 is a view showing a process for performing a vacuum process by putting the explosive charged rubber bag of FIG. 1 in a vacuum box.
Figure 3:
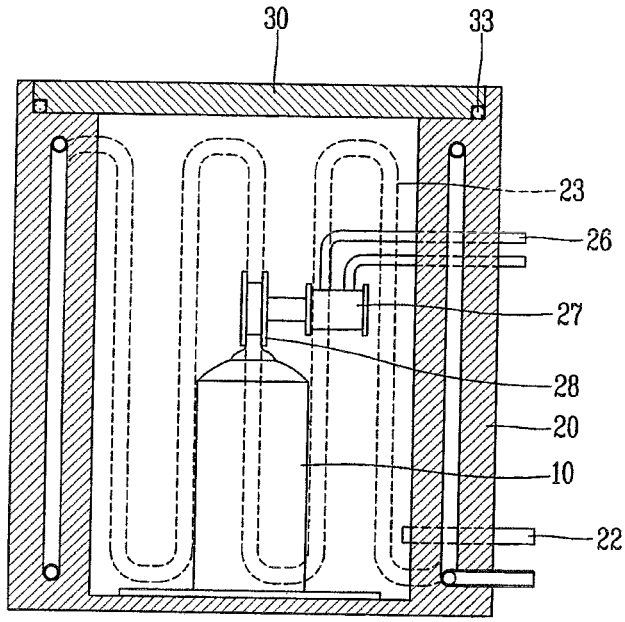
FIG. 3 is a sectional view of the vacuum box of FIG. 2.

FIG. 2 is a view showing a process for performing a vacuum process by putting the explosive charged rubber bag of FIG. 1 in a vacuum box, and FIG. 3 is a sectional view of the vacuum box of FIG. 2.

Once explosive powder has been charged in the rubber bag 11, the explosive charged rubber bag 10 undergoes a vacuum process so as to remove air included in the explosive powder. As shown in FIGS. 2 and 3, the explosive charged rubber bag 10 is disposed in a vacuum box 20, and then is covered by a cover 30. Under this state, a vacuum process is performed. An O-ring 33 for maintaining a vacuum state during the vacuum process is provided between the cover 30 and the vacuum box 20. The cover 30 may include a transparent window 31 through which inside of the vacuum box 20 can be viewed during the vacuum process.

Since air inside the vacuum box 20 is removed through a vacuum line 22 connected to a vacuum pump, the inside of the vacuum box 20 is in a vacuum state. Here, the inlet 12 of the explosive charged rubber bag 10 is open, and the rubber bag 11 is disposed in the vacuum box 20. Accordingly, a pressure difference does not occur between the inside and outside of the rubber bag 11 during the vacuum process. As a result, the inlet 12 of the rubber bag 11 is not sealed.

A first heater 23 configured to maintain a constant temperature inside the vacuum box 20 during the vacuum process may be provided at an inner space or a side wall of the vacuum box 20.

Once the inside of the vacuum box 20 is in a vacuum state and air included in the explosive powder charged in the explosive charged rubber bag 10 is removed according to time lapse, the inlet 12 of the explosive charged rubber bag 10 is sealed by a temporary inlet sealing means. As the temporary inlet sealing means, a hydraulic or pneumatic cylinder 27 may be used. The cylinder 27 is connected to a suitable means for closing the inlet 12, e.g., a pair of plates 28 for sealing the inlet 12 by pressing. The cylinder 27 is configured to be manipulated from outside, and is controlled by a fluid line 26.

In a state that the inlet 12 of the explosive charged rubber bag 10 has been sealed, the cover 30 is open to release the vacuum state. In this case, the inside of the explosive charged rubber bag 10 maintains the vacuum state since the inlet 12 is in a sealed state. Here, a lower end of the inlet 12 of the explosive charged rubber bag 10 is sealed again by a clamp 40, thereby releasing the fixed state of the cylinder 27. The clamp 40 serves to maintain the vacuum state inside the explosive charged rubber bag 10 while the explosive charged rubber bag 10 is moved to another position.

Figure 4:
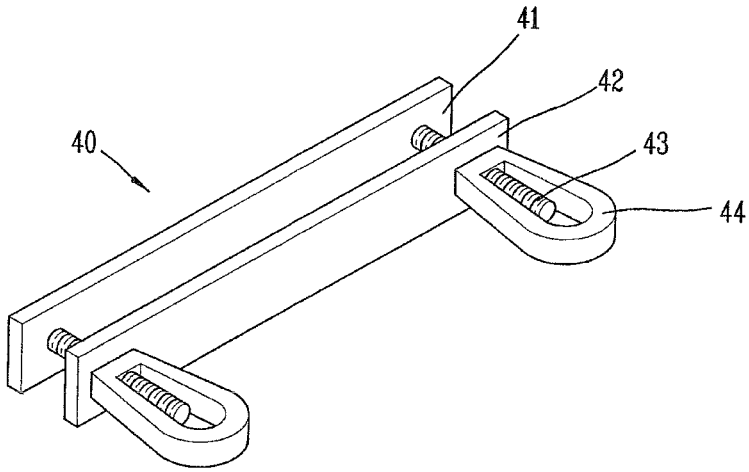
FIG. 4 is a perspective view showing an example of a clamp for sealing an inlet of the explosive charged rubber bag which is in a vacuums state.

FIG. 4 is a perspective view showing an example of the clamp for sealing the inlet of the explosive charged rubber bag which is in a vacuums state.

Referring to FIG. 4, the clamp 40 includes a fixed plate 41 and a moveable plate 42 configured to seal the inlet of the explosive charged rubber bag 10 in a pressing manner by narrowing a gap therebetween. The fixed plate 41 and the moveable plate 42 are coupled to bolts 43 and nuts 44 so as to have a variable gap therebetween. For facilitated controls, the bolts 43 are fixed to the fixed plate 41, and the nuts 44 may have wide handgrips for rapid clamping without any tool. Differently from the configuration shown in FIG. 4, the clamp may be implemented by various mechanism, such as a latch type for implementing a locked state in a switching manner, or a type for implementing a locked state in a pull or push manner.

Figure 5:
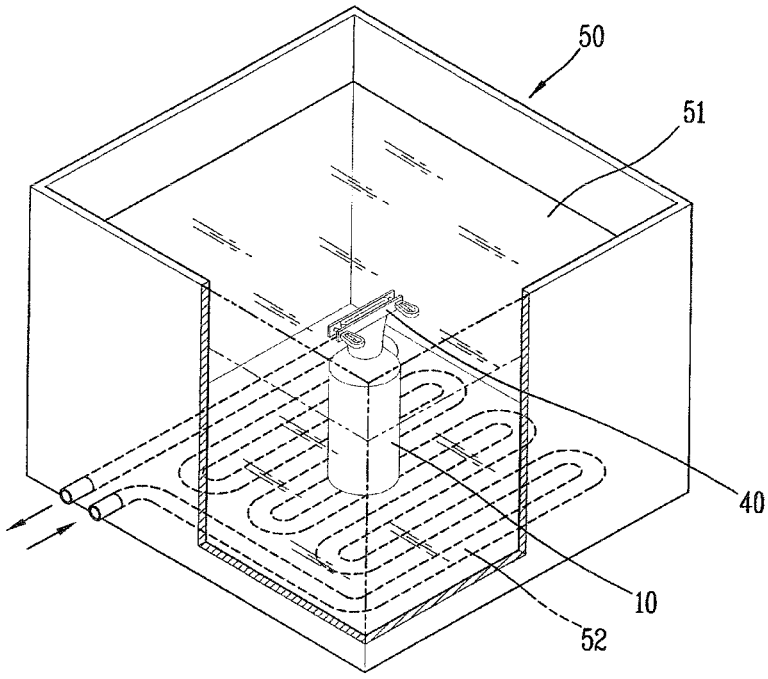
FIG. 5 is a view showing a process for maintaining a vacuum state of the explosive charged rubber bag by disposing the explosive charged rubber bag in a water tank.

FIG. 5 is a view showing a process for maintaining a vacuum state of the explosive charged rubber bag by disposing the explosive charged rubber bag in a water tank.

The vacuum state of the explosive charged rubber bag 10 implemented by the clamp 40 need to be stably maintained until the explosive charged rubber bag 10 undergoes isostatic pressing. For this, in the present invention, the explosive charged rubber bag 10 is disposed in a tank containing a fluid so as to shield the explosive charged rubber bag 10 from external air. In an atmospheric state, even if the inlet 12 of the explosive charged rubber bag 10 is well sealed, air may be introduced into a minute gap of the sealed inlet 12 of the explosive charged rubber bag 10. This may lower a vacuum degree inside the explosive charged rubber bag 10 as time lapses. Accordingly, the explosive charged rubber bag 10 is disposed in the fluid to prevent air introduction thereinto.

As shown in FIG. 5, the explosive charged rubber bag 10 may be soaked in a water tank 50 containing water 51 therein. The explosive charged rubber bag 10 is kept in the water 51 contained in the water tank 50 until a plurality of rubber bag charge bodies are formed.

In order to constantly maintain an operation temperature of the explosive charged rubber bag 10 which is in a vacuum state while the explosive charged rubber bag 10 is kept, a second heater 52 may be provided at the water tank 50. The second heater 52 may serve to constantly maintain the temperature of the explosive charged rubber bag 10 by heating the water 51.

In order to completely maintain a vacuum state inside the explosive charged rubber bag in a case of consecutive massive productions, investment in facilities is increased, and processes become complicated. However, in the present invention, a minute gap of the explosive charged rubber bag 10 is sealed by water, thereby preventing a vacuum state from changing into a non-vacuum state. This may allow the vacuum state to be maintained in simple and effective manners.

Figure 6:
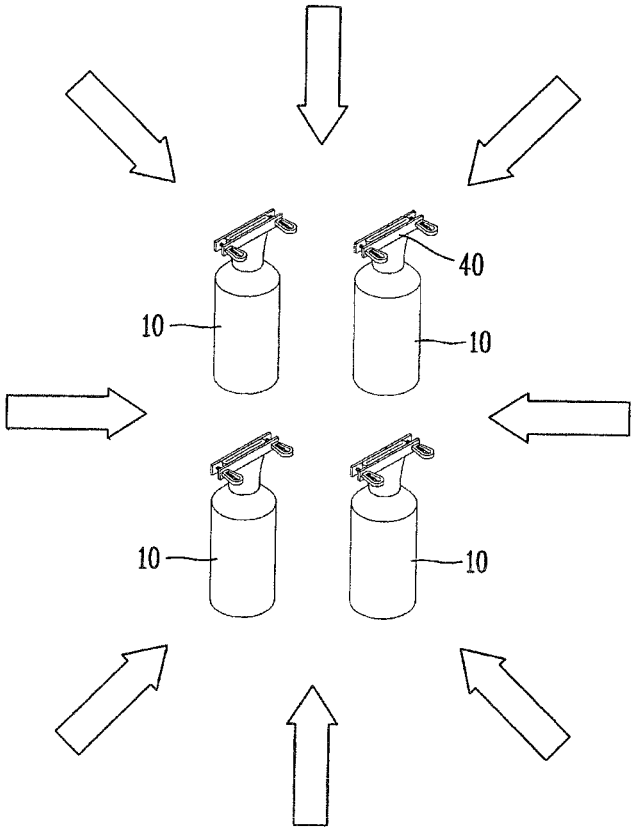
FIG. 6 is a conceptual view showing a process for molding rubber bag charge bodies kept in a water tank by an isostatic pressing device.

FIG. 6 is a conceptual view showing a process for molding rubber bag charge bodies kept in the water tank by an isostatic pressing device. Referring to FIG. 6, a plurality of the rubber bag charge bodies 10 which are in a vacuum state are collected, the rubber bag charge bodies 10 are molded at one time by using an isostatic pressing device.

As aforementioned, in the present invention, the vacuum process is performed by using the vacuum box 20 and the water reservoir 50. This may allow the explosive charged rubber bag 10 to maintain a vacuum state for a long time, differently from the conventional explosive charged rubber bag having a vacuum degree lowered according to time lapses in an atmospheric state.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An apparatus for a vacuum process of isostatic pressing of powder material, the apparatus comprising:

a rubber bag configured to charge powder therein;

a vacuum box configured to accommodate the rubber bag, and to provide a vacuum environment of the rubber bag;

a cylinder assembly configured to seal an inlet of the rubber bag disposed in the vacuum box, wherein the cylinder assembly is arranged in the vacuum box;

a clamp configured to completely seal the inlet of the rubber bag having been temporarily sealed by the cylinder assembly;

a fluid reservoir configured to position the rubber bag, having the inlet sealed by the clamp, at a predetermined depth; and a pair of plates connected to the cylinder assembly, the plates being configured to seal the inlet of the rubber bag by pressing.

2. The apparatus of claim 1, wherein the cylinder assembly comprises at least one of a hydraulic cylinder assembly and a pneumatic cylinder assembly.

3. The apparatus of claim 1, wherein the clamp comprises:

a fixed plate and a moveable plate configured to seal the inlet by pressing the inlet of the rubber bag by narrowing a gap therebetween;

bolts fixed to one of the fixed plate and the moveable plate; and nuts coupled to the bolts.

4. The apparatus of claim 1, wherein the reservoir comprises a water reservoir containing water therein.

5. The apparatus of claim 1, further comprising a first heater disposed in the vacuum box, and configured to control an operation temperature of the rubber bag.

6. The apparatus of claim 1, further comprising a second heater disposed in the fluid reservoir, and configured to constantly maintain an operation temperature of the rubber bag.

* * * * *